United States Patent [19]

Taniguchi et al.

[11] Patent Number: 4,731,354

[45] Date of Patent: Mar. 15, 1988

[54] THERMOSENSITIVE RECORDING MATERIAL

[75] Inventors: Keishi Taniguchi; Hiromi Huruya, both of Shizuoka, Japan

[73] Assignee: Ricoh Company, Ltd., Tokyo, Japan

[21] Appl. No.: 931,086

[22] Filed: Nov. 17, 1986

[30] Foreign Application Priority Data

Nov. 20, 1985 [JP] Japan ..... 60-262024

[51] Int. Cl.[4] ..... B41M 5/22

[52] U.S. Cl. ..... 503/209; 427/150; 427/151; 503/208; 503/217

[58] Field of Search ..... 346/208, 209; 427/150–152; 503/208, 209, 217

[56] References Cited

U.S. PATENT DOCUMENTS 4,633,277 12/1986 Suzuki et al. ..... 427/151

FOREIGN PATENT DOCUMENTS 0089449 5/1985 Japan ..... 346/209

1029587 2/1986 Japan ..... 346/209

*Primary Examiner*—Bruce H. Hess

*Attorney, Agent, or Firm*—Oblon, Fisher, Spivak, McClelland & Maier

[57] ABSTRACT

A thermosensitive recording material is disclosed, which comprises a support material and a thermosensitive coloring layer formed thereon comprising a leuco dye, a color developer capable of inducing color formation in the leuco dye upon application of heat thereto, and a diether compound having the following general formula (I):

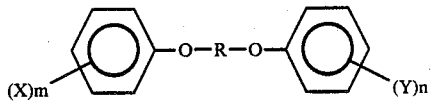

(I)

wherein R represents a straight or branched hydrocarbon having 2 to 12 carbon atoms, including 1 to 4 double bonds therein, X and Y each represent an alkyl group having 1 to 6 carbon atoms; an alkoxy group having 1 to 6 carbon atoms; halogen; an aryl group; an aralkyl group; an acyloxy group (R'COO—), wherein R' is an alkyl group having 1 to 6 carbon atoms; an aryloxy group; or an aralkyloxy group; and m and n each represent an integer of 1 to 3.

9 Claims, No Drawings

THERMOSENSITIVE RECORDING MATERIAL

BACKGROUND OF THE INVENTION

The present invention relates to a thermosensitive recording material, and more particularly to a thermosensitive recording material having excellent coloring performance.

A conventional thermosensitive recording material comprises a support material, such as a sheet of paper or a film, and a thermosensitive coloring layer formed thereon, which comprises a coloring system consisting of a colorless or light-colored coloring dye such as a leuco dye and a color developer capable of inducing color formation in the coloring dye upon application of heat thereto such as a phenolic compound (for example, Bisphenol A) and an organic acidic material. In addition to the above coloring system, the thermosensitive coloring layer further comprises a binder agent, a filler, a thermal sensitivity improvement agent, a lubricant and other auxiliary agents. Examples of such thermosensitive recording material are disclosed, for example, in Japanese Patent Publication No. 43-4160, Japanese Patent Publication No. 45-14039, and Japanese Laid-Open Patent Application No. 48-27736.

In a thermosensitive recording material of this type, a colored image is obtained by a chemical reaction between a coloring agent and a color developer upon application of heat thereto, for instance, through a thermal head which is built in a thermal printer or a facsimile apparatus.

Such thermosensitive recording material has the advantages over other conventional recording materials that recording can be performed in a short time by use of a comparatively simple device without the need for complicated processes such as developing and fixing, almost no noise is generated and no environmental pollution problems occur during operation, and the cost is low. Because of these advantages, the thermosensitive recording material has wide-scale utilization, not only as the recording material for copying books and documents, but also as the recording material for use with computers, facsimile apparatus, telex, medical instruments, other apparatus for recording information, and measuring instruments.

In accordance with the recent demand for high speed recording with high recording density, not only the development of a high speed recording apparatus, but also the development of recording materials that can be used with such a high speed recording apparatus is desired.

A first method by which the above demand could be met is to decrease the melting point of an electron acceptor serving as color developer as much as possible for use in practice, for instance, to 80° to 120° C., taking into consideration the conditions for preserving the color developer, so that the co-melting initiation temperature with a leuco dye is decreased, thus it is tried to attain high speed recording. This method, however, will not be employed in practice, because it is extremely difficult to adjust the melting point of the phenolic compounds which are widely used as the color developer at present in the field of thermosensitive recording material, and because the cost of the phenolic compounds will become high if it is tried to do so.

A second method by which the above demand can be met to some extent is to add a thermofusible material to the thermosensitive coloring layer in such a manner that the thermofusible material is caused to work as a sensitizer or a melting point reducing agent for the thermosensitive coloring layer as described in Japanese Laid-Open Patent Applications Nos. 53-39139, 53-26139, 53-5636 and 53-11036. Examples of such a thermofusible material are various waxes, fatty acid amides, alkylated biphenyl, substituted biphenyl alkane, coumarine, coumarine derivatives, and diphenylamine. The density of the colored images, the coloring sensitivity and the degree of whiteness of the background obtained by the thermosensitive recording materials using such thermofusible materials in the thermosensitive coloring layer, however, are still poor.

SUMMARY OF THE INVENTION

It is therefore an object of the present invention to provide a thermosensitive recording material suitable for practical use in high speed recording, having high coloring sensitivity and capable of yielding images with high coloring density and high degree of whiteness of the background.

According to the present invention, the above object is attained by a thermosensitive recording material comprising a support material and a thermosensitive coloring layer formed thereon comprising a leuco dye, a color developer capable of inducing color formation in the leuco dye upon application of heat thereto, and a diether compound having the following general formula (I):

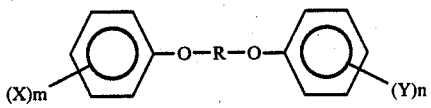

(I)

wherein R represents a straight or branched hydrocarbon having 2 to 12 carbon atoms, including 1 to 4 double bonds therein, X and Y each represent an alkyl group having 1 to 6 carbon atoms; an alkoxy group having 1 to 6 carbon atoms; halogen; an aryl group such as a phenyl group and a naphthyl group each of which may have as a substituent an alkyl group having 1 to 6 carbon atoms, an alkoxy group having 1 to 6 carbon atoms, or halogen; an aralkyl group such as a benzyl group, a phenethyl group, a naphthylmethyl group and a naphthylethyl group each of which may have as a substituent an alkyl group having 1 to 6 carbon atoms, an alkoxy group having 1 to 6 carbon atoms; an acyloxy group (R'COO—), wherein R' is an alkyl group having 1 to 6 carbon atoms; an aryloxy group such as a phenyloxy group and a naphthyloxy group, each of which may have as a substituent an alkyl group having 1 to 6 carbon atoms, an alkoxy group having 1 to 6 carbon atoms or halogen; or an aralkyloxy group such as a benzyloxy group, a phenethyloxy group, a naphthylmethyloxy group and a naphthylethyloxy group, each of which may have as a substituent an alkyl group having 1 to 6 carbon atoms, an alkoxy group having 1 to 6 carbon atoms, or halogen; and m and n each represent an integer of 1 to 3.

DETAILED DESCRIPTION OF THE PREFERRED EMBODIMENTS

The diether compound represented by the above general formula has the function of dissolving leuco dyes (electron-donating colorless dyes) and color developers (electron-accepting compounds) for inducing color formation in the leuco dyes (which are now widely employed in the field of thermosensitive recording material) when they are heated. Therefore, by selecting a diether compound having an appropriate melting point, a thermosensitive recording material with the desired thermal sensitivity can be obtained.

The diether compound represented by the general formula (I) for use in the present invention includes cis- and trans-geometrical isomers. The above-mentioned effect of the diether compound has nothing to do with the geometrical isomerism, so that both a pure cis- or trans-geometrical isomer and a mixture of the cis- and trans-geometrical isomers can be used equally.

In the present invention, it is preferable to use a diether compound having a melting point ranging from 40° C. to 150° C., more preferably, ranging from 50° C. to 120° C., in view of the preservability, stability and thermal sensitivity of the thermosensitive recording material.

A list of specific examples of preferable diether compounds for use in the present invention may include, but is not restricted to, the following:

(1)

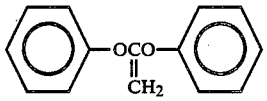

(2)

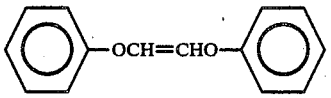

(3)

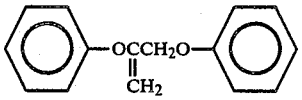

(4)

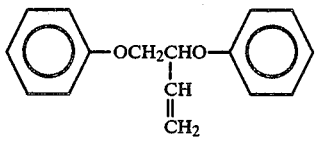

(5)

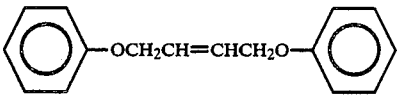

(6)

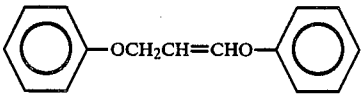

(7)

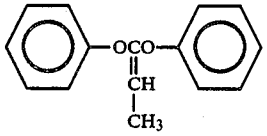

(8)

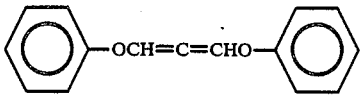

-continued (9)

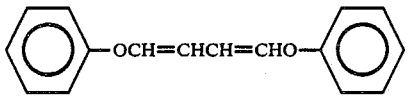

(10)

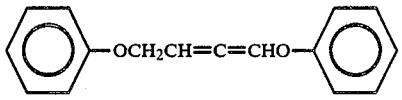

(11)

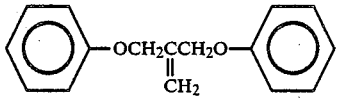

(12)

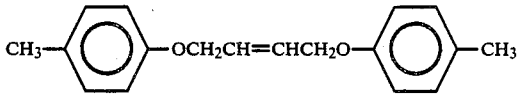

(13)

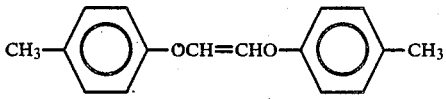

(14)

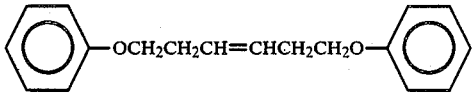

(15)

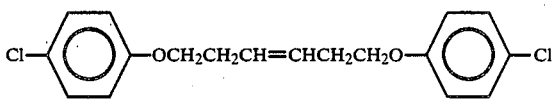

(16)

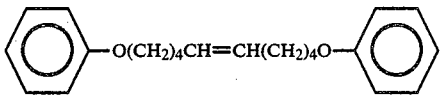

(17)

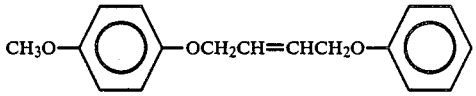

(18)

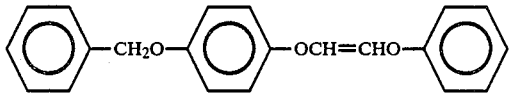

(19)

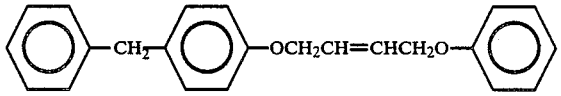

(20)

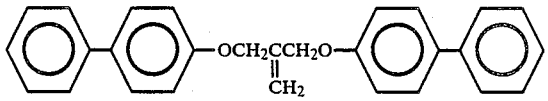

-continued

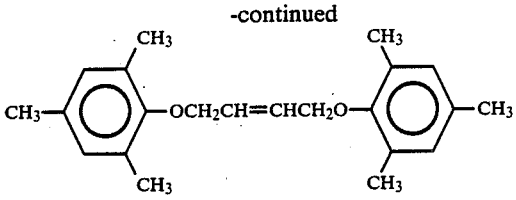

(21)

As the leuco dyes for use in the present invention, any conventional leuco dyes for use in conventional thermo-sensitive recording materials can be employed. For example, triphenylmethane-type leuco compounds, fluoran-type leuco compounds, phenothiazine-type leuco compounds, auramine-type leuco compounds, spiropyran-type leuco compounds and indolinophthalide-type leuco compounds are preferably employed.

Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-isoamylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)fluoran,
benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4,4'-chloro-5'-methylphenyl)phthalide,
3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)fluoran,
3-(N-benzyl-N-cyclohexylamino)-5,6-benzo-7-α-naphthylamino-4'-bromofluoran,
3-diethylamino-6-chloro-7-anilinofluoran,
3-N-ethyl-N-(2-ethoxypropyl)amino-6-methyl-7-anilinofluoran,
3-N-ethyl-N-tetrahydrofurfrylamino-6-methyl-7-anilinofluoran, and
3-diethylamino-6-methyl-7-mesidino-4',5'-benzofluoran.

As the color developers for use in combination with the above leuco dyes in the present invention, a variety of electron acceptors can be employed, such as phenolic materials, thiophenol compounds, thiourea derivatives, organic acids and metal salts thereof.

Specific examples of the above color developers are as follows: 4,4'-isopropylidenebisphenol, 4,4'-isopropylidene-bis(o-methylphenol), 4,4'-sec-butylidenebisphenol, 4,4'-isopropylidenebis(2-tert-butylphenol), 4,4'-cyclohexylidenediphenol, 4,4'-isopropylidenbis(2-chlorophenol), 2,2'-methylenebis(4-methyl-6-tert-butylphenol), 2,2'-methylenebis (4-ethyl-6-tert-butylphenol), 4,4'-butylidenbis(6-tert-butyl-2-methyl)phenol, 4,4'-thiobis(6-tert-butyl-2-methyl) phenol, 4,4'-diphenolsulfone, 4,4'-diphenolsulfoxide, isopropyl p-hydroxybenzoate, benzyl p-hydroxybenzoate, benzyl protocatechuate, stearyl gallate, lauryl gallate, octyl gallate, 1,7-bis(4-hydroxyphenylthio)-3,5-dioxaheptane, 1,5-bis(4-hydroxyphenylthio)-3-oxapentane, 1,3-bis(4-hydroxyphenylthio)-propane, 1,3-bis(4-hydroxyphenylthio)-2-hydroxypropane, N,N'-diphenylthiourea, N,N'-di(m-chlorophenyl)thiourea, salicylanilide, 5-chlorosalicylanilide, salicyl-o-chloroanilide, 2-hydroxy-3-naphthoic acid, 2-hydroxy-1-naphthoic acid, 1-hydroxy-2-naphthoic acid, and metal salts of hydroxy naphthoic acid such as zinc, aluminum and calcium salts.

In the present invention, a variety of conventional binder agents can be employed for binding the above mentioned leuco dyes and color developers in the thermosensitive coloring layer to the support material.

Specific examples of such binder agents are as follows: polyvinyl alcohol; starch and starch derivatives; cellulose derivatives such as methoxycellulose, hydroxyethylcellulose, carboxymethylcellulose, methylcellulose and ethylcellulose; water-soluble polymeric materials such as sodium polyacrylate, polyvinylpyrrolidone, acrylamide/acrylic acid ester copolymer, acrylamide/acrylic acid ester/methacrylic acid copolymer, styrene/maleic anhydride copolymer alkali salt, isobutylene/maleic anhydride copolymer alkali salt, polyacrylamide, sodium alginate, gelatin and casein; and latexes of polyvinyl acetate, polyurethane, styrene/butadiene copolymer, polyacrylic acid, polyacrylic acid ester, vinyl chloride/vinyl acetate copolymer, polybutylmethacrylate, ethylene/vinyl acetate copolymer and styrene/butadiene/acrylic acid derivaive copolymer.

Further in the present invention, auxiliary additive components which are employed in the conventional thermosensitive recording materials, such as a filler, a surface active agent and a thermofusible material (or unguent), can be employed.

Specific examples of a filler for use in the present invention are finely-divided inorganic powders of calcium carbonate, silica, zinc oxide, titanium oxide, aluminum hydroxide, zinc hydroxide, barium sulfate, clay, talc, surface-treated calcium and surface-treated silica, and finely-divided organic powders of urea-formaldehyde resin, styrene/methacrylic acid copolymer, and polystyrene.

The thermosensitive recording material according to the present invention can be prepared, for example, by applying a thermosensitive coloring layer formation liquid containing the above-mentioned components to an appropriate support material such as paper, synthetic paper or a plastic film, and drying the applied liquid. The preferable amounts of the leuco dye, the color developer and the diether compound are respectively 5 to 40 wt.%, 20 to 60 wt.% and 20 to 60 wt.% based on the total amount of the three components.

Embodiments of the thermosensitive recording material according to the present invention will now be explained with reference to the following examples.

EXAMPLE 1

A dispersion A-1, a dispersion B-1, a dispersion C-1, and a dispersion D-1 were separately prepared by grinding and dispersing the following respective components in a ball mill:

| | Parts by Weight |
|---|---|
| [Dispersion A-1] | |
| 3-(N—methyl-N—cyclohexylamino)-6-methyl-7-anilinofluoran | 20 |
| 10% aqueous solution of polyvinyl alcohol | 20 |
| Water | 60 |
| [Dispersion B-1] | |
| Bisphenol A | 20 |
| 10% aqueous solution of polyvinyl alcohol | 20 |
| Water | 60 |
| [Dispersion C-1] | |
| 1,4-diphenoxy-2-butene (Diether Compound No.(5), a mixture of the trans-isomer and the cis-isomer with a ratio of 9:1, having a melting point of 84 to 86° C.) | 20 |
| 10% aqueous solution of polyvinyl alcohol | 20 |
| Water | 60 |
| [Dispersion D-1] | |
| Calcium carbonate | 20 |
| 10% aqueous solution of polyvinyl alcohol | 20 |
| Water | 60 |

10 parts by weight of the dispersion A-1, 30 parts by weight of the dispersion B-1, 30 parts by weight of the dispersion C-1, 20 parts by weight of the dispersion D-1 and 5 parts by weight of a 10% aqueous solution of polyvinyl alcohol were mixed to prepare a thermosensitive coloring layer formation liquid.

This thermosensitive coloring layer formation liquid was coated on a sheet of high quality paper (a basis weight of 50 g/m$^2$) with a deposition of 4 to 5 g/m$^2$ on a dry basis and was then dried, whereby a thermosensitive coloring layer was formed thereon. The thus prepared thermosensitive recording material was subjected to calendering, so that the surface of the thermosensitive coloring layer was made smooth to the degree ranging from 500 to 600 sec, whereby a thermosensitive recording material No. 1 according to the present invention was prepared.

EXAMPLE 2

Example 1 was repeated except that the dispersion B-1 employed in Example 1 was replaced by a dispersion B-2 with the following formulation, whereby a thermosensitive recording material No. 2 according to the present invention was prepared.

| [Dispersion B-2] | Parts by Weight |
|---|---|
| Benzyl p-hydroxybenzoate | 20 |
| 10% aqueous solution of polyvinyl alcohol | 20 |
| Water | 60 |

EXAMPLE 3

Example 1 was repeated except that the dispersion B-1 employed in Example 1 was replaced by a dispersion B-3 with the following formulation, whereby a thermosensitive recording material No. 3 according to the present invention was prepared.

| [Dispersion B-3] | Parts by Weight |
|---|---|
| 1,7-bis(4-hydroxyphenylthio)-3,5-dioxaheptane | 20 |
| 10% aqueous solution of polyvinyl alcohol | 20 |
| Water | 60 |

COMPARATIVE EXAMPLE 1-1

Example 1 was repeated except that the dispersion C-1 employed in Example 1 was replaced with water, whereby a comparative thermosensitive recording material No. 1-1 was prepared.

COMPARATIVE EXAMPLE 2-1

Example 2 was repeated except that the dispersion C-1 employed in Example 2 was replaced with water, whereby a comparative thermosensitive recording material No. 2-1 was prepared.

COMPARATIVE EXAMPLE 3-1

Example 3 was repeated except that the dispersion C-1 employed in Example 3 was replaced with water, whereby a comparative thermosensitive recording material No. 3-1 was prepared.

COMPARATIVE EXAMPLE 1-2

Example 1 was repeated except that the dispersion C-1 employed in Example 1 was replaced by a dispersion CC-1 with the following formulation, whereby a comparative thermosensitive recording material No. 1-2 was prepared.

| [Dispersion CC-1] | Parts by Weight |
|---|---|
| Stearamide | 20 |
| 10% aqueous solution of polyvinyl alcohol | 20 |

-continued

| [Dispersion CC-1] | Parts by Weight |
|---|---|
| Water | 60 |

COMPARATIVE EXAMPLE 2-2

Example 2 was repeated except that the dispersion C-1 employed in Example 2 was replaced by the dispersion CC-1 employed in Comparative Example 1-2, whereby a comparative thermosensitive recording material No. 2-2 was prepared.

COMPARATIVE EXAMPLE 3-2

Example 3 was repeated except that the dispersion C-1 employed in Example 3 was replaced by the dispersion CC-1 employed in Comparative Example 1-2, whereby a comparative thermosensitive recording material No. 3-2 was prepared.

The thus prepared thermosensitive recording materials No. 1 through 3 according to the present invention and the comparative thermosensitive recording materials Nos. 1-1, 1-2, 2-1, 2-2, 3-1 and 3-2 were subjected to thermal printing by use of a thermal printing test apparatus including a thermal head of a thin film type (made by Matsushita Electronic Components Co., Ltd.) under the conditions that the power applied to the head was 0.45 W/dot, the recording time per line was 20 msec, the scanning line density was 8×3.85 dots/mm, with the pulse width applied thereto changed to 3 steps of 1.6 msec, 2.0 msec, and 2.4 msec. The density of the developed images was measured by Macbeth densitometer RD-514 with a filter W-106. The results are shown in the following Table 1.

TABLE 1

| | Thermosensitive Recording Material | Developed Image Density Pulse width (msec) 1.6 | 2.0 | 2.4 | Background Density |
|---|---|---|---|---|---|
| Example 1 | No. 1 | 1.04 | 1.19 | 1.29 | 0.08 |
| Comparative Example 1-1 | No. 1-1 | 0.54 | 0.85 | 1.06 | 0.08 |
| Comparative Example 1-2 | No. 1-2 | 0.80 | 1.11 | 1.27 | 0.08 |
| Example 2 | No. 2 | 1.27 | 1.33 | 1.37 | 0.08 |
| Comparative Example 2-1 | No. 2-1 | 1.08 | 1.26 | 1.27 | 0.08 |
| Comparative Example 2-2 | No. 2-2 | 1.10 | 1.27 | 1.33 | 0.08 |
| Example 3 | No. 3 | 1.28 | 1.36 | 1.39 | 0.07 |
| Comparative Example 3-1 | No. 3-1 | 1.10 | 1.28 | 1.32 | 0.07 |
| Comparative Example 3-2 | No. 3-2 | 1.12 | 1.30 | 1.35 | 0.07 |

The thermosensitive recording materials No. 1 through 3 according to the present invention and the comparative thermosensitive recording materials Nos. 1-1, 1-2, 2-1, 2-2, 3-1 and 3-2 were then subjected to a preservative test by allowing each sample to stand at 60° C. for 24 hours to investigate the changes in the background density before the test and after the test. The results are as shown in Table 2.

TABLE 2

| | Thermosensitive Recording Material | Backgound Density Before Test | After Test |
|---|---|---|---|
| Example 1 | No. 1 | 0.07 | 0.12 |
| Comparative Example 1-1 | No. 1-1 | 0.07 | 0.12 |
| Comparative Example 1-2 | No. 1-2 | 0.09 | 0.18 |
| Example 2 | No. 2 | 0.08 | 0.10 |
| Comparative Example 2-1 | No. 2-1 | 0.08 | 0.09 |
| Comparative Example 2-2 | No. 2-2 | 0.08 | 0.12 |
| Example 3 | No. 3 | 0.07 | 0.09 |
| Comparative Example 3-1 | No. 3-1 | 0.07 | 0.08 |
| Comparative Example 3-2 | No. 3-2 | 0.07 | 0.11 |

What is claimed is:

1. A thermosensitive recording material comprising a support material and a thermosensitive coloring layer formed thereon comprising a leuco dye, a color developer capable of inducing color formation in said leuco dye upon application of heat thereto and a diether compound having the following general formula (I):

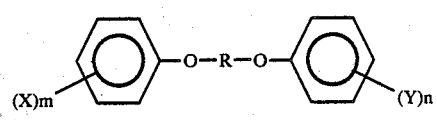

(I)

wherein R represents a straight or branched hydrocarbon having 2 to 12 carbon atoms, including 1 to 4 double bonds therein, X and Y each represent an alkyl group having 1 to 6 carbon atoms; an alkoxy group having 1 to 6 carbon atoms; halogen; an aryl group; an aralkyl group; an acyloxy group (R'COO—), wherein R' is an alkyl group having 1 to 6 carbon atoms; an aryloxy group; or an aralkyloxy group; and m and n each represent an integer of 1 to 3.

2. The thermosensitive recording material as claimed in claim 1, wherein said aryl group is selected from the group consisting of a phenyl group and a naphthyl group, each of which may have as a substituent an alkyl group having 1 to 6 carbon atoms, an alkoxy group having 1 to 6 carbon atoms, or halogen.

3. The thermosensitive recording material as claimed in claim 1, wherein said aralkyl group is selected from the group consisting of a benzyl group and a phenethyl group, a naphthylmethyl group and a naphthlethyl group, each of which may have a substituent an alkyl group having 1 to 6 carbon atoms, an alkoxy group having 1 to 6 carbon atoms, or halogen.

4. The thermosensitive recording material as claimed in claim 1, wherein said aryloxy group is selected from the group consisting of a phenyloxy group and a naphthyloxy group, each of which may have a substituent an alkyl group having 1 to 6 carbon atoms, an alkoxy group having 1 to 6 carbon atoms, or halogen.

5. The thermosensitive recording material as claimed in claim 1, wherein said aralkyloxy group is selected from the group consisting of a benzyloxy group, a phenethyloxy group, a naphthylmethyloxy group, a naphthylethyloxy group, each of which may have a substituent an alkyl group having 1 to 6 carbon atoms, an alkoxy group having 1 to 6 carbon atoms, or halogen.

6. The thermosensitive recording material as claimed in claim 1, wherein said diether compounds is selected from the group consisting of:

(1) 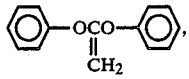

(2) 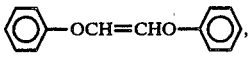

(3) 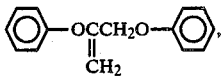

(4) 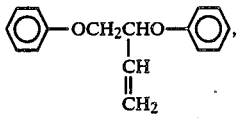

(5) 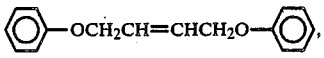

(6) 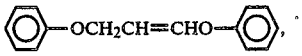

(7) 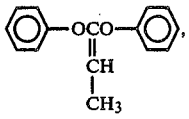

(8) 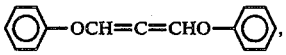

(9) 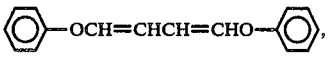

(10) 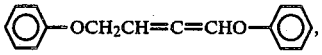

(11) 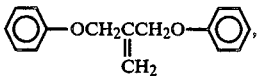

(12) 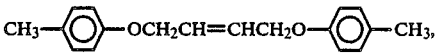

(13) 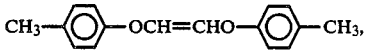

(14) 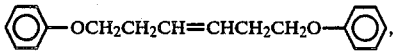

(15) 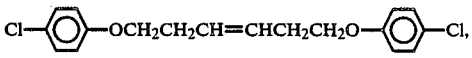

-continued

(16) 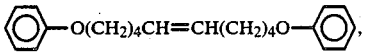

(17) 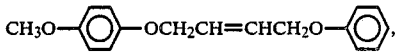

(18) 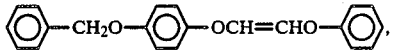

(19) 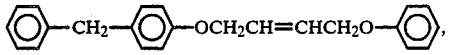

(20 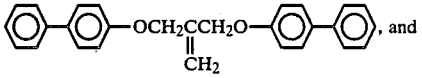 , and

(21) 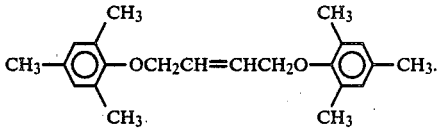 .

7. The thermosensitive recording material as claimed in claim 1, wherein said leuco dye is selected from the group consisting of triphenylmethane-type leuco compounds, fluoran-type leuco compounds, phenothiazine-type leuco compounds, auramine-type leuco compounds, spiropyran-type leuco compounds and indolinophthalide-type leuco compounds.

8. The thermosensitive recording material as claimed in claim 1, wherein said color developer is selected from the group consisting of 4,4'-isopropylidenebisphenol, 4,4'-isopropylidene-bis(o-methylphenol), 4,4'-sec-butylidenebisphenol, 4,4'-isopropylidenebis(2-tert-butylphenol), 4,4'-cyclohexylidene-diphenol, 4,4'-isopropylidenbis(2-chlorophenol), 2,2'-methylenebis(4-methyl-6-tert-butylphenol), 2,2-methylenebis(4-ethyl-6-tert-butylphenol), 4,4'-butylidenbis(6-tert-butyl-2-methyl)phenol, 4',4-thiobis(6-tert-butyl-2-methyl)-phenol, 4,4'-diphenosulfone, 4,4'-diphenolsulfoxide, isopropyl p-hydroxybenzoate, benzyl p-hydroxybenzoate, benzyl protocatechuate, stearyl gallate, lauryl gallate, octyl gallate, 1-7-bis(4-hydroxyphenylthio)-3,5-dioxa-heptane, 1-5-bis(4-hydroxdyphenylthio)-3-oxa-pentane, 1,3-bis((4-hydroxyphenylthio)-propane, 1,3-bis(4-hydroxyphenylthio)-2-hydroxypropane, N,N'-diphenylthiourea, N,N'-di(m-chlorophenyl)thiourea, salicylanilide, 5-chloro-salicylanilide, salicyl-o-chloroanilide, 2-hydroxy-3-naphthoic acid, 2-hydroxy-1-napthoic acid, 1-hydroxy-2-napthoic acid and metal salts of hydroxy naphthoic acid.

9. The thermosensitive recording material as claimed in claim 1, wherein the amounts of said leuco dye, said color developer and said diether compound are respectively in the ranges of 5 to 40 wt.%, 20 to 60 wt.% and 20 to 60 wt.% based on the total amount by weight of said three components.

* * * * *